US009444136B2

(12) United States Patent
Lam et al.

(10) Patent No.: US 9,444,136 B2
(45) Date of Patent: Sep. 13, 2016

(54) CONFIGURABLE ANTENNA SYSTEM AND METHOD

(75) Inventors: Alan Lam, Hong Kong (CN); Vincent Lam, Hong Kong (CN); Samuel Wong, Hong Kong (CN)

(73) Assignee: General Wireless IP Holdings LLC, Fort Worth, TX (US)

( * ) Notice: Subject to any disclaimer, the term of this patent is extended or adjusted under 35 U.S.C. 154(b) by 348 days.

(21) Appl. No.: 14/112,145

(22) PCT Filed: Apr. 21, 2011

(86) PCT No.: PCT/CN2011/073122

§ 371 (c)(1),
(2), (4) Date: Oct. 16, 2013

(87) PCT Pub. No.: WO2012/142762

PCT Pub. Date: Oct. 26, 2012

(65) Prior Publication Data

US 2014/0043205 A1 Feb. 13, 2014

(51) Int. Cl.
*H01Q 1/42* (2006.01)
*H01Q 1/08* (2006.01)

(52) U.S. Cl.
CPC ..... *H01Q 1/42* (2013.01); *H01Q 1/08* (2013.01); *Y10T 29/49016* (2015.01)

(58) Field of Classification Search
CPC ..... H01Q 1/08; Y10T 29/49016
See application file for complete search history.

(56) References Cited

U.S. PATENT DOCUMENTS 5,119,459 A 6/1992 Meyerhoefer et al.
2008/0278399 A1* 11/2008 Nakajima ..... H01Q 1/1207 343/872
2009/0068009 A1* 3/2009 Yang ..... F04D 25/0613 415/213.1
2009/0322645 A1* 12/2009 Sun ..... H01Q 1/42 343/872

FOREIGN PATENT DOCUMENTS

| | | |
|---|---|---|
| CN | 1767075 | 5/2006 |
| CN | 101382151 | 3/2009 |
| CN | 202159773 | 3/2012 |
| DE | 202007015899 | 1/2008 |

OTHER PUBLICATIONS

International Search Report issued for PCT/CN2011/073122 dated Dec. 26, 2011, 9 pages.

(Continued)

*Primary Examiner* — Trinh Dinh

(74) *Attorney, Agent, or Firm* — Haynes and Boone, LLP

(57) ABSTRACT

An antenna for receiving a transmitted signal with signal receiving components including a housing disposed about signal-receiving components. The housing includes a first housing portion forming a first side of the housing, the first housing portion including first and second opposing edge portions, third edge portion extending between the first and second opposing edge portions, and a second housing portion forming a second side of the housing, the second housing portion including fourth and fifth opposing edge portions, and a sixth edge portion extending between the fourth and fifth opposing edge portions, wherein the first housing portion is configured to be coupled to the second housing portion in such a manner that the first and fourth edge portions engage, the second and fifth edge portions engage, and the third and sixth edge portions cooperatively form an elongated groove configured to receive a signal line.

21 Claims, 9 Drawing Sheets

(56) References Cited

OTHER PUBLICATIONS

Chinese Office Action and Search Report with English translation issued for CN 201110199241.X dated Apr. 16, 2014, 10 pgs.

English Translation of CN 202159773 dated Mar. 7, 2012, 6 pgs.

Taiwanese Office Action and Search Report with English translation issued for TW 100127831 dated May 27, 2014, 6 pgs.

* cited by examiner

CONFIGURABLE ANTENNA SYSTEM AND METHOD

CROSS-REFERENCE TO RELATED APPLICATION

This application is a United States national phase application of co-pending international patent application number PCT/CN2011/073122, filed Apr. 21, 2011, the disclosure of which is incorporated herein by reference.

BACKGROUND

Conventional indoor television antennas are generally meant to be positioned near the television to which they transmit received signals. Some antennas are designed to rest on surfaces near the television, some are designed to sit in stands, and some are designed to hang on an adjacent wall. In each of these cases, a transmission line carrying television signals from the antenna to the television must also be positioned relative to the antenna. However, indoor television antennas often lack means to dictate the manner in which the transmission line extends from the antenna. While existing devices, for example those described above, have been generally adequate for their intended purposes, they have not been entirely satisfactory in all respects. The embodiments of the present disclosure overcome one or more of the shortcomings of the prior art.

SUMMARY

In one exemplary aspect, the present disclosure is directed to an antenna for receiving a transmitted signal with signal receiving components. The antenna may include a signal line electrically coupled to signal-receiving components and a housing disposed about the signal-receiving components and securably connected with the signal line. The housing may include a first housing portion forming a first side of the housing, the first housing portion including first and second opposing edge portions, a third edge portion extending between the first and second opposing edge portions, and a plurality of spaced teeth protruding from the third edge portion. The housing may also include a second housing portion forming a second side of the housing, the second housing portion including fourth and fifth opposing edge portions, and a sixth edge portion extending between the fourth and fifth opposing edge portions, the sixth edge portion including a first notch adjacent to the fourth edge portion and a second notch adjacent to the fifth edge portion. The first housing portion may be configured to be coupled to the second housing portion in such a manner that the first and fourth edge portions engage to form a first housing edge portion, the second and fifth edge portions engage to form a second housing edge portion, and the first and second housing portion form a cavity therebetween, the signal-receiving components being disposed within the cavity. The first housing portion may also be configured to be coupled to the second housing portion in such a manner that the third and sixth edge portions cooperatively form an elongated groove extending between the first and the second housing edge portions, the groove being configured to receive the signal line, the plurality of spaced teeth extending into the groove and being configured to releasably secure the signal line in the groove, and the first and second notches being in communication with the groove to allow the signal line to exit the groove through one of the first and second notches.

In some instances, the first housing portion may include a first wall portion adjacent to the third edge portion, the first wall portion including a first aperture portion. The second housing portion may include a second wall portion adjacent to the sixth edge portion, the second wall portion including a second aperture portion. The first housing portion may be further configured to be coupled to the second housing portion in such a manner that the first wall portion engages the second wall portion and the first aperture portion and the second aperture portion form an aperture in communication with the groove, the signal line extending through the aperture and into the groove.

In other instances, the antenna may include a removable stand having first and second elongated channels structurally configured to releasably secure the signal line therein. The removable stand may be configured to receive the housing in such a manner that the first notch aligns with the first elongated channel and the second notch aligns with the second elongated channel to allow the signal line to extend through the groove and either pass through the first notch and extend through the first elongated channel or pass through the second notch and extend through the second elongated channel.

In another exemplary aspect, the present disclosure is directed to an antenna system with a housing having signal-receiving components therein. The housing may include a front surface portion, a back surface portion spaced from the front surface portion to form a cavity therebetween, the signal-receiving components being disposed within the cavity, an edge portion extending between the front surface portion and the back surface portion, the edge portion having a first end and an opposing second end and including a groove extending between the first and second ends, wherein the back surface portion includes a first notch in communication with the groove. The antenna system may also include a signal line electrically coupled to the signal-receiving components disposed within the cavity, the signal line extending through an aperture formed in the edge portion within the groove. The antenna system may further include a stand structurally configured to receive the housing. The stand may include a first bracket structurally configured to releasably receive the housing and an first elongated channel extending away from the first bracket and being structurally configured to receive the signal line therein, wherein the stand is operable to receive the housing in such a manner that the first notch on the back surface portion aligns the first elongated channel to allow the signal line to extend through the groove, pass through the first notch and extend through the first elongated channel.

In some instances, the back surface portion of the housing includes a second notch in communication with the groove, wherein the first notch is adjacent to the first end of the edge portion and wherein the second notch is adjacent to the second end of the edge portion. The stand may include a second bracket configured to releasably receive the housing, a second elongated channel extending away from the second bracket and being structurally configured to receive the signal line therein. The stand may be further operable to receive the housing in such a manner that the second notch on the back surface portion aligns with the second elongated channel to allow the signal line to extend through the groove, pass through the second notch and extend through the second elongated channel.

In other instances, the housing of the antenna system may include a first set of positioners and the stand may include a second set of positioners configured to engage the first set of positioners. The stand may be further operable to receive the housing in such a manner that the first set of positioners engages the second set of positioners to align the first notch with the first elongated channel and to reduce movement of the housing relative to the stand.

In another exemplary aspect, the present disclosure is directed to a method of using an antenna system. The method may include locating a signal line extending from an edge portion of an antenna housing, the signal line electrically coupled to signal-receiving components disposed within the antenna housing. The method may also include inserting the signal line into a groove along the edge portion of the antenna housing, the edge portion including a plurality of teeth protruding into the groove to releasably secure the signal line within the groove. The method may further include passing the signal line through a notch in the antenna housing, the notch extending approximately perpendicularly from the groove. The method may also include releasably securing the antenna housing to a stand and inserting the signal line into an elongated channel on the stand so that the signal line extends away from the antenna housing, the elongated channel being configured to releasably secure the signal line.

In some instances, the releasably securing the antenna housing to the stand may include positioning the antenna housing within the stand to align the notch with the elongated channel. Further, the positioning the antenna housing may include engaging a first pair of positioners on the antenna housing with a second pair of positioners on the stand.

DETAILED DESCRIPTION

Figure 1:
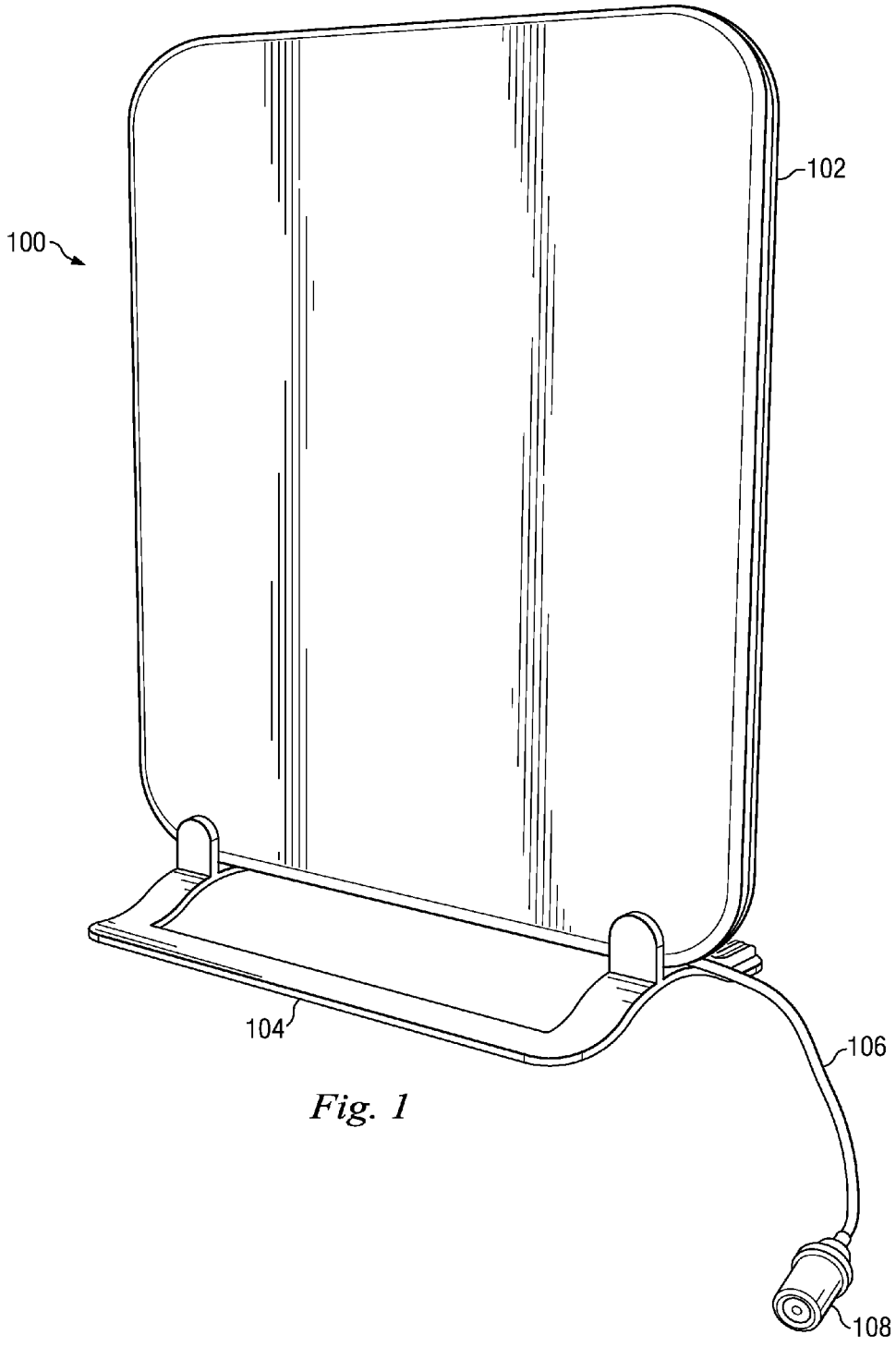
FIG. 1 is a diagrammatic perspective view of a antenna system according to an embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of the disclosure is intended. Any alterations and further modifications in the described devices, instruments, methods, and any further application of the principles of the disclosure as described herein are contemplated as would normally occur to one skilled in the art to which the disclosure relates. In particular, it is fully contemplated that the features, components, and/or steps described with respect to one embodiment may be combined with the features, components, and/or steps described with respect to other embodiments of the present disclosure.

FIG. 1 is a diagrammatic perspective view of an antenna system 100 according to an embodiment of the present disclosure. The antenna system 100 includes a flat panel housing 102, a removable stand 104, a signal line 106, and a coupler 108 disposed at the end of the signal line. These components will be described in greater detail in association with FIGS. 2-9. In general, the antenna system 100 is operable to receive television signals and transmit them to a television receiver coupled to the coupler 108. As will be described herein, the antenna system 100 may be configured in a number of different arrangements to facilitate convenient user placement of the antenna.

Figure 2:
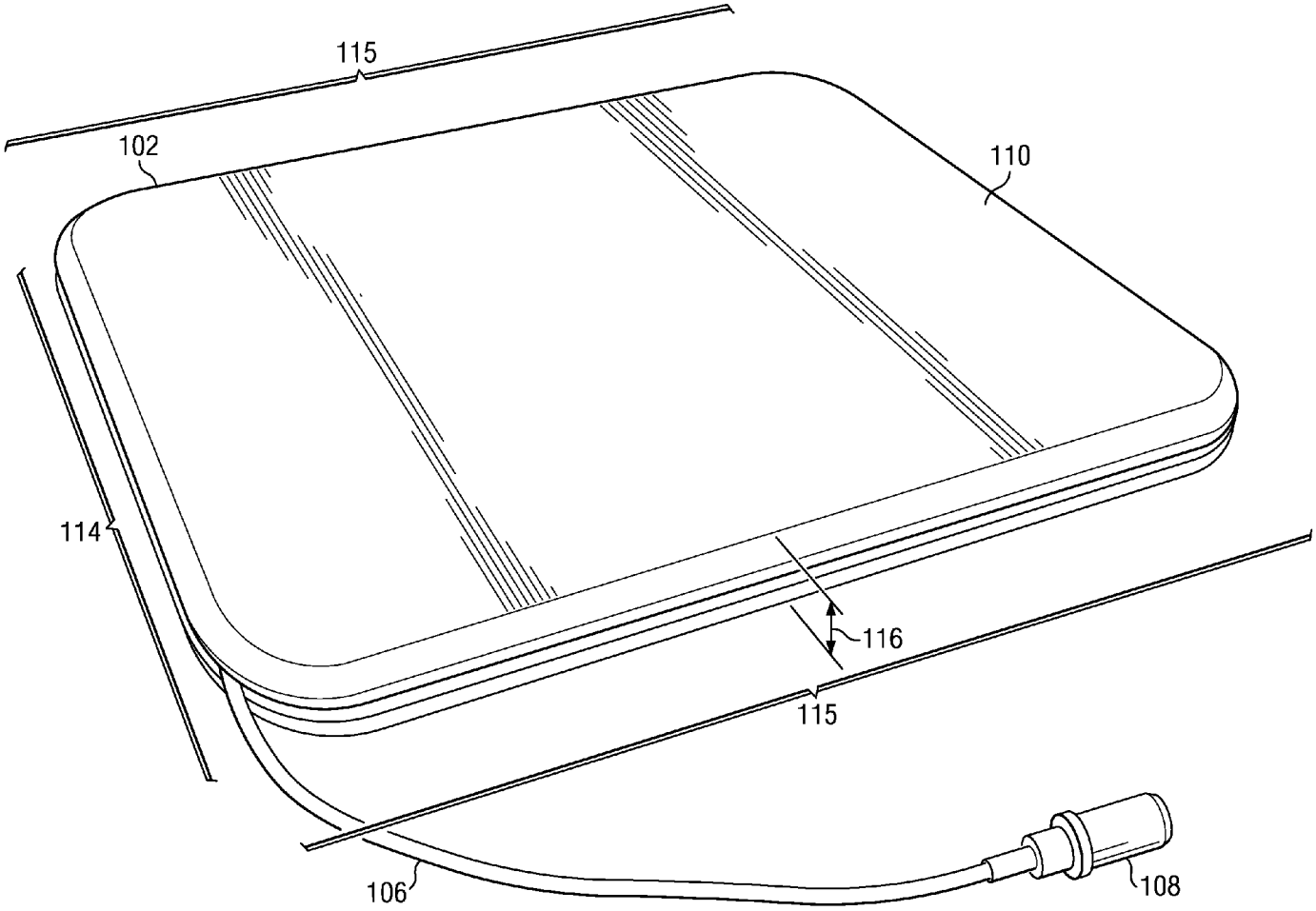
FIG. 2 is a diagrammatic perspective view of a flat panel housing that is an aspect of the antenna system of FIG. 1.
Figure 3:
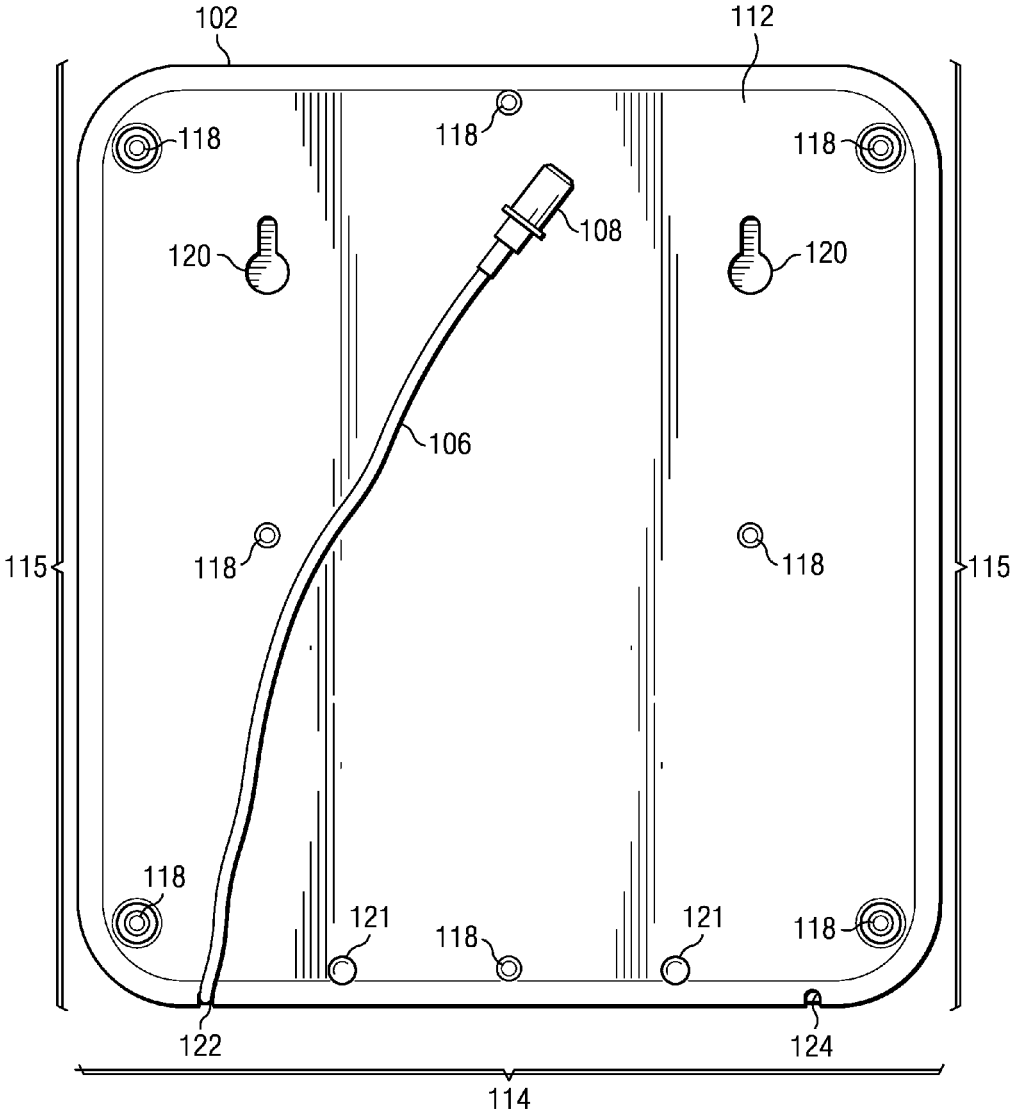
FIG. 3 is a diagrammatic rear view of the flat panel housing of FIG. 2.

With reference now to FIGS. 2 and 3, illustrated is an aspect of the antenna system 100, specifically, the flat panel housing 102. FIG. 2 is a diagrammatic perspective view of the housing 102, and FIG. 3 is a diagrammatic rear view of the housing. In general, the flat panel housing is configured to protect signal-receiving components housed therein. Note that a patent application entitled "Efficient Loop Antenna System and Method" and filed on Oct. 16, 2013 having been assigned U.S. application Ser. No. 14/112,185 discloses signal-receiving components of a loop antenna system that may be disposed within the housing 102 and is hereby incorporated by reference in its entirety. The housing 102 includes a front cover 110 and a back cover 112. In the illustrated embodiment, the front and back covers 110 and 112 are formed out of commercially available, durable plastic, but alternatively, they may be formed of other materials. Generally, at their peripheries, the front cover 110 and back cover 112 curve inward approximately ninety degrees such that they engage each other and form a cavity therein. More specifically, the housing 102 includes a bottom edge portion 114 that includes a cable management groove that will be described in association with FIGS. 4-5. Along opposing edges 115 of the housing 102, the front and back cover 110 and 112 each include cooperative curved edge portions configured such that, when the covers are coupled together, the edge portions engage to form the continuous edges 115 of the housing. But, along the bottom edge portion 114, the front and back cover 110 and 112 include cooperating curved edge portions configured such that, when the covers are coupled together, the edge portions do not engage but instead form a cable management groove described in greater detail below. The above mentioned edge portions will be described in association with FIGS. 4-6.

The housing 102 has a generally uniform thickness 116, which, in the illustrated embodiment, is approximately 12-13 mm. However, the housing 102 may be thicker or thinner in other embodiments. Further, the signal line 106 is electrically coupled to signal-receiving components disposed within the housing 102, passes from the cavity in the housing to an exterior of the housing through an aperture in the bottom edge portion 114 (described below with reference to FIG. 6), and is electrically coupled to the coupler 108. In the illustrated embodiment, the signal line 106 is a coaxial transmission line and the coupler 108 is a coaxial connector. In alternative embodiments, the signal line and coupler may be different types of electrical cables and couplers.

Further, as shown in FIG. 3, the back cover 112 includes a plurality of apertures 118 that are each aligned with a threaded support protruding from the front cover 110 within the cavity. The front and back covers 110 and 112 may be coupled together by screws that pass through the apertures, threadably engage the threaded supports on the front cover, and compressively engage the back cover around each of the apertures 118. Additionally, the back cover 112 includes a pair of hanging slots 120 configured to accept and engage the head of a screw or other mounting device. Using the slots 120, a user may hang the housing 102 from a wall or other planar surface. The back cover 112 further includes a pair of concave positioners 121. The concave positioners 121 are configured to mate with a pair of convex positioners on the removable stand 104, as will be described in association with FIG. 8. Still further, the back cover 112 includes two notches 122 and 124 that are adjacent to the bottom edge portion 114. In the illustrated embodiment, the signal line 106 passes through the notch 122, but it may instead pass through notch 124. The notches 122 and 124 will be described in greater detail with reference to FIGS. 4-6.

Figure 4:
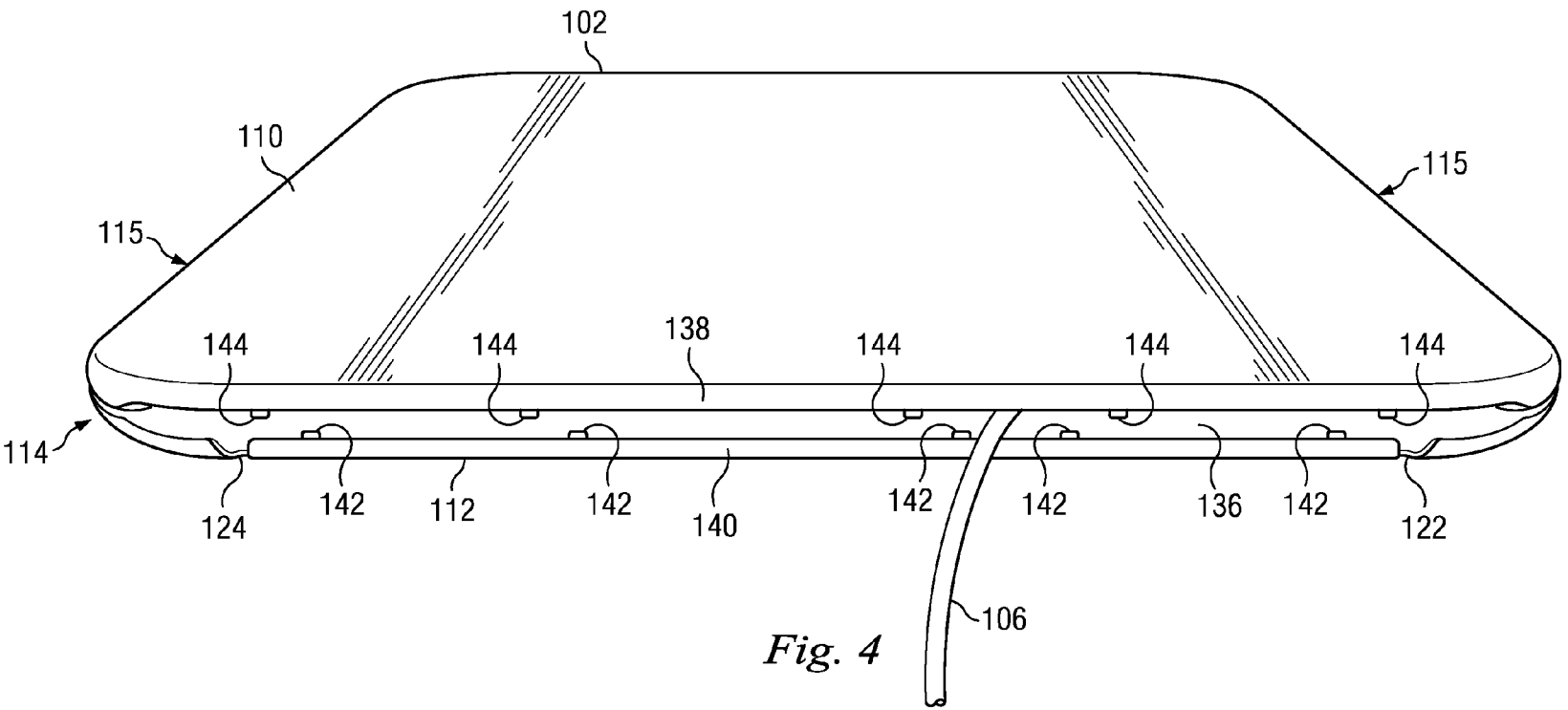
FIG. 4 is a diagrammatic perspective end view of the flat panel housing of FIG. 2 showing a cable management groove.
Figure 5:
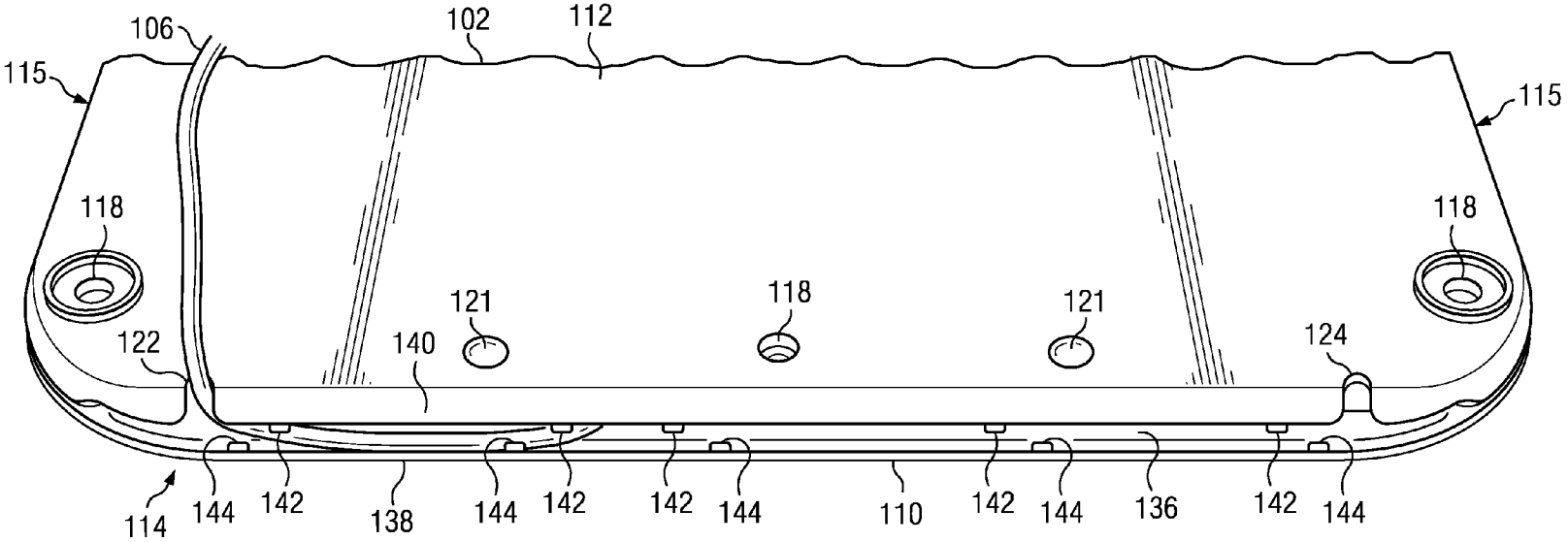
FIG. 5 is a partial diagrammatic perspective rear view of the flat panel housing of FIG. 2 showing the cable management groove.

With reference now to FIGS. 4 and 5, illustrated is an aspect of the flat panel housing 102, specifically a cable management groove 136. FIG. 4 is a diagrammatic perspective end view of the flat panel housing 102 showing the cable management groove 136, and FIG. 5 is a partial diagrammatic perspective rear view of the housing 102 showing the cable management groove 136. In more detail, the cable management groove 136 substantially extends along the bottom edge portion 114 of the flat panel housing 102 from one edge 115 of the housing 102 to an opposing edge 115, such that the groove ends are open and face in the direction of the opposing edges 115. As mentioned above, the groove 136 is formed by cooperating curved edge portions 138 and 140 of the front and back covers 110 and 112. The signal line 106 exits the housing and enters the groove 136 through an aperture within the groove 136, partially shown in FIG. 6. The groove 136 is structurally configured to guide the signal line as it extends across the bottom edge portion 114, as shown in FIG. 5. To keep the signal line within the groove 136, the back cover 112 includes retainers, such as for example, a plurality of spaced teeth 142 and the front cover 110 includes retainers, such as for example, a plurality of spaced teeth 144. The teeth 142 and 144 protrude from the covers across the groove 136 to hold the signal line 106 within the groove. Further, as shown in FIGS. 4 and 5, the plurality of spaced teeth 142 are offset from the plurality of spaced teeth 144.

Further, the notches 122 and 124 in the back cover 112 are positioned on opposing ends of the bottom edge portion 114 and each extend substantially perpendicularly from the groove 136. The widths of the notches 122 and 124 are only slightly larger than the diameter of the signal line 106 such that when the signal line is placed in one of the notches it is releasably secured. The notches 122 and 124 are further structurally configured such that when the signal line passes through one of them, it may extend from the housing 120 in a manner approximately perpendicular to the back cover 112. The groove 136 further is structurally configured such that the signal line has 180 degrees of freedom as it leaves the housing 102. For example, the signal line may extend in an approximately perpendicular fashion from the groove 136, as shown in FIG. 4, or it may exit the housing 102 and extend out of one of the openings at either end of the groove 136 such that it extends from the left or right of the housing in a manner parallel to and along an axis of the groove, in the manner shown in FIG. 2. Still further, the groove 136 is structurally configured such that the signal line 106 may extend through the groove and remain hidden until it passes through one of the notches 122 and 124, enabling a clean and appealing appearance. Thus, using the groove 136 and the notches 122 and 124, a user of the antenna system 100 may position the signal line 106 such that it extends from the housing 102 in a convenient and predictable manner.

Figure 6:
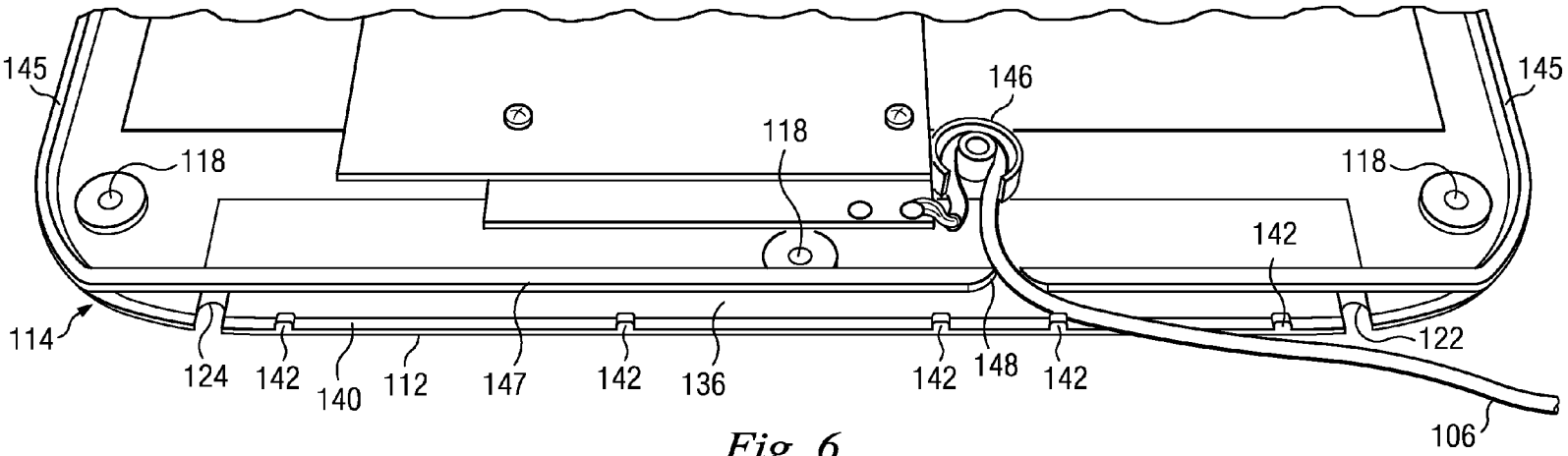
FIG. 6 is a partial diagrammatic perspective top view of the flat panel housing of FIG. 2 with a front cover removed.

With reference now to FIG. 6, illustrated is a partial diagrammatic perspective top view of the flat panel housing 102 with the front cover 110 removed. As mentioned above, the back cover 112 includes opposing curved edge portions 145 that engage cooperating opposing curved edge portions on the front cover 110 when the covers are coupled together. Further, as shown in FIG. 6, the signal line 106 is electrically coupled to signal-receiving components within the housing 102. However, before the signal line 106 exits the housing 102, it wraps around a strain reliever 146. The strain reliever 146 includes a circular channel through which the signal line 106 extends. The strain reliever 146 is structurally configured to absorb any tension applied on the signal line 106 from outside the housing 102 and to reduce movement of the signal line within the housing. In this manner, the signal line may remain electrically coupled to signal-receiving components even when forcefully adjusted by a user of the antenna system 100. Further, after the signal line 106 passes through the strain reliever 146, it exits the housing 102 through an aperture formed in a wall extending down the groove 136. More specifically, the inside of the back cover 112 includes a wall portion 147 and a semi-circular aperture portion 148 formed in the wall portion 147. And the non-illustrated inside of the front cover 110 includes a matching wall portion and semi-circular aperture portion disposed to correspond with the wall portion 147 and the aperture portion 148. When the front and back covers 110 and 112 are coupled together the wall portions engage and the semi-circular aperture portions form an aperture through which the signal line 106 may pass.

Figure 7:
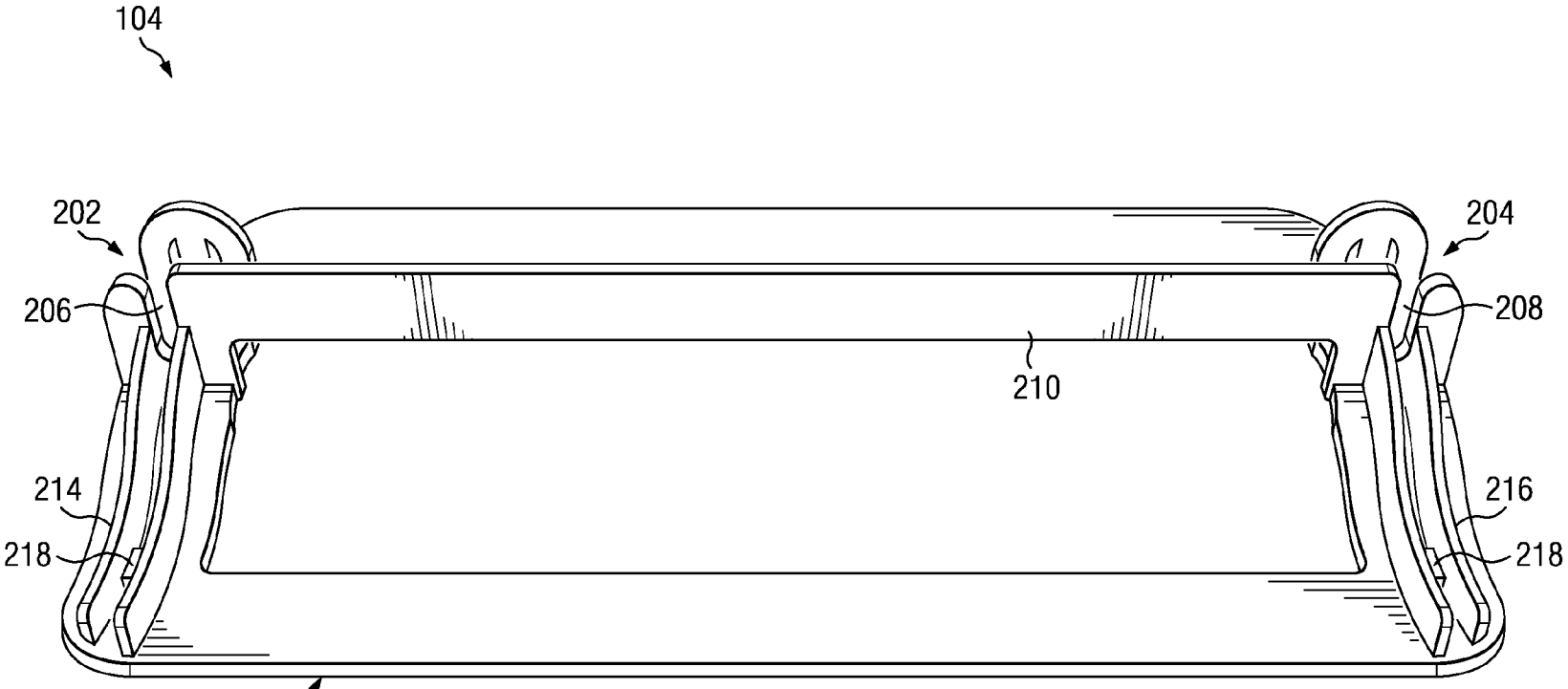
FIG. 7 is a diagrammatic perspective side view of a removable stand that is an aspect of the antenna system of FIG. 1.
Figure 8:
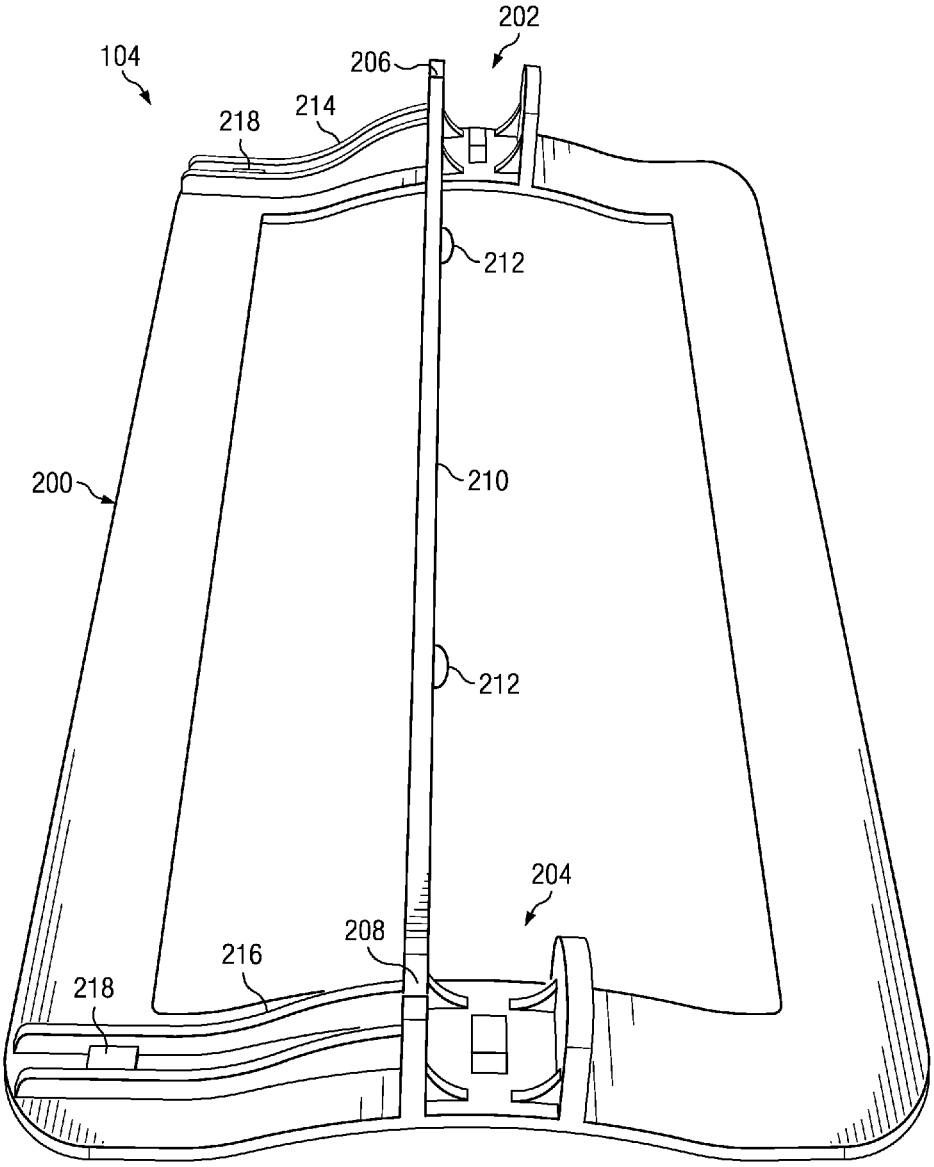
FIG. 8 is a diagrammatic perspective end view of the removable stand of FIG. 7.

With reference now to FIGS. 7 and 8, illustrated is another aspect of the antenna system 100, specifically, the removable stand 104. FIG. 7 is a diagrammatic perspective side view of the removable stand 104, and FIG. 8 is a diagrammatic perspective end view of the removable stand 104. In general, the removable stand 104 is structurally configured to rest on a flat surface and hold the flat panel housing 102 in a substantially perpendicular manner with respect to the flat surface. In more detail, the stand 104 includes a rectangular base 200 with two coplanar elongated portions configured to rest on a planar surface. The base 200 further includes two arched portions respectively positioned at and connecting opposing ends of the elongated portions. The stand 104 includes a bracket 202 and a bracket 204 each respectively positioned at the apex of the arched portions of the base 200. The brackets 202 and 204 comprise spaced elements that are structurally configured to engage the front and back covers 110 and 112 of the housing 102 such that when the housing sits in the space between the elements of the brackets, it stands in a plane substantially perpendicular to the surface on which the base 200 rests. Further, the space between the elements of the brackets 202 and 204 is only slightly larger than the width 116 of the housing 102 such that the elements are operable to releasably secure the housing. Additionally, the bracket 202 includes a cable slot 206 and the bracket 204 includes a cable slot 208. When the housing 102 is optimally positioned in the stand 104, the notch 122 on the back cover 112 will align with the cable slot 206 and the notch 124 will align with the cable slot 208.

The stand 104 further includes a strut 210 that connects the brackets 202 and 204 and is operable to further support the housing 102 when it is engaged by the brackets. Specifically, the strut 210 is structurally configured to engage the back cover 112 of the housing 102. The strut 210 includes a pair of convex positioners 212 that are structurally configured to mate with the concave positioners 121 (FIG. 3) on the back cover 112 when the housing 102 rests in the brackets 202 and 204. The convex positioners 208 are operable to position the housing 102 within the removable stand 104 such that the cable slot 206 is aligned with the notch 122 and the cable slot 208 is aligned with the notch 124, and also to prevent movement of the housing with respect to the stand. The removable stand 104 further includes a cable channel 214 that extends down an arched portion of the base 200 from the cable slot 206 and a cable channel 216 that extends down the opposing arched portion from the cable slot 208. The widths of the cable channels are only slightly larger than the diameter of the signal line 106 such that the signal line may be releasably secured when positioned in either of the channels. In the example shown, the cable channel 214 and 216 each include a retainer, such as for example, a tooth 218, to further secure the signal line 106 when it is positioned in one of the channels. In the illustrated embodiment, the removable stand 104 is a one-piece, molded component formed out of commercially-available, durable plastic, but alternatively, it may be formed of another material.

Figure 9:
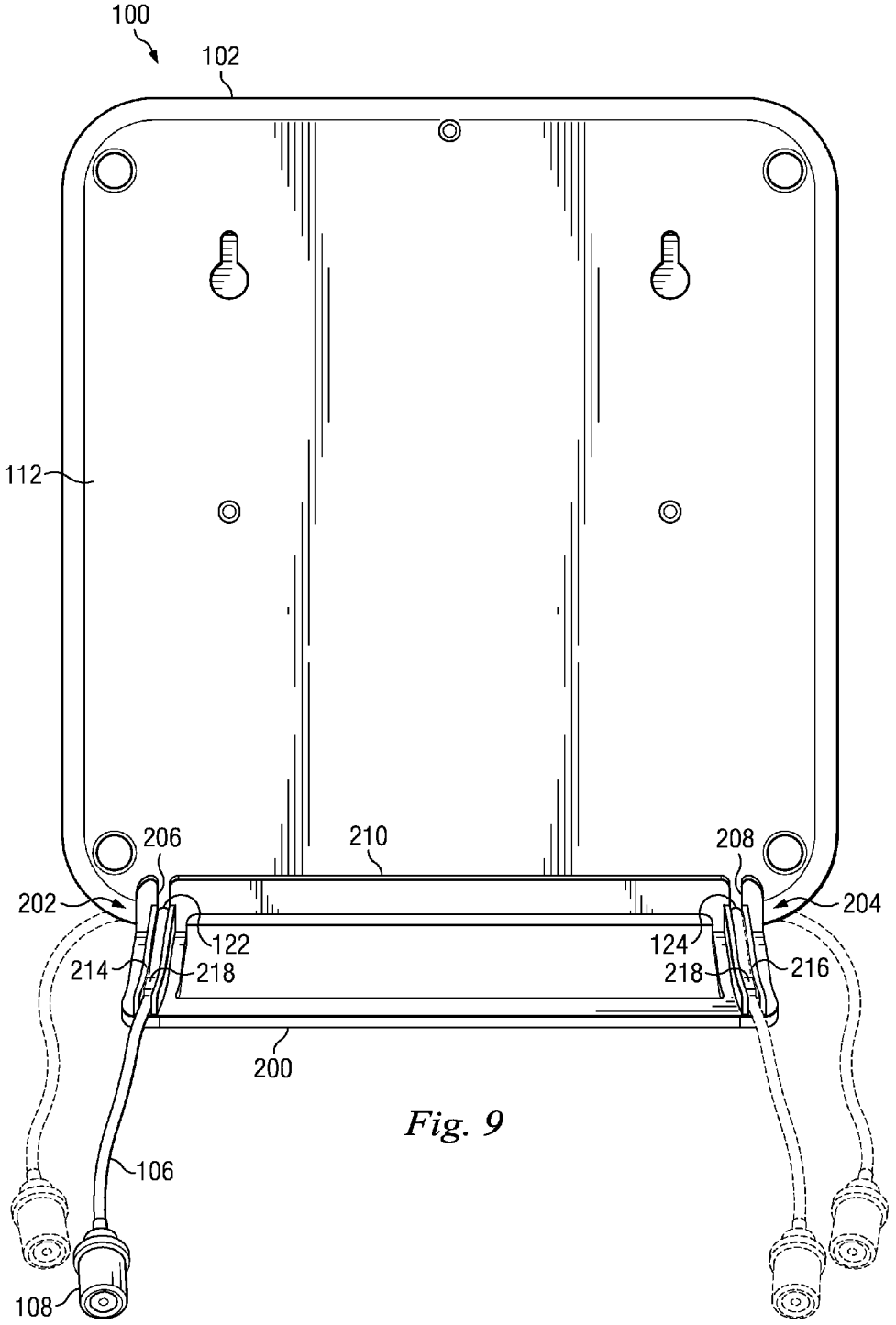
FIG. 9 is a diagrammatic rear view of the flat panel housing of FIG. 2 positioned in the removable stand of FIG. 7.

With reference now to FIG. 9, illustrated is the antenna system 100 in one user configuration. In more detail, FIG. 9 is diagrammatic rear view of the housing 102 positioned in the stand 104. As shown in FIG. 9, when the housing 102 rests in the stand 104, the brackets 202 and 204 releasably engage the front and back covers 110 and 112 and the strut 210 engages the back cover 112. Further, the convex positioners 212 (FIG. 8) engage the concave positioners 121 (FIG. 3) to align the notch 122 on the back cover 112 with the cable slot 206 on the stand 104 and the notch 124 with the cable slot 208. Because of the material properties of the stand 104, the strut 210 may deflect slightly when the housing 102 is introduced. When the housing 102 is properly located, the convex positioners 212 snap into the concave positioners 121, providing tactile feedback to the user. The positioners 121 and 212 secure and maintain the housing 102 in the stand 104 in a manner that mechanically couples the two together. In the user configuration shown in FIG. 9, the signal line 106 extends through the cable management groove 136, passes through the notch 122 and the cable slot 206, and extends through the cable channel 214, where it is held in place by the tooth 218. Further, a user may choose different user configurations of the antenna system 100 in which the signal line extends from the housing 102 in a different manner. For instance, as shown in broken lines in FIG. 9, the signal line 106 may be positioned such that it extends through the cable management groove 136, passes through the notch 124 and the cable slot 208, and extends through the cable channel 216. Additionally, as also shown in broken lines in FIG. 9, the signal line 106 may be configured to extend through the groove 136 and out of either side of the housing 102 without passing through either cable channel on the stand 104. This latter user configuration is also shown in FIG. 1.

In this manner, a user of the antenna system 100 has control over the manner in which the signal line 106 extends from the housing 102. That is, the user may select any one of a plurality of predefined pathways for the signal line 106 based upon the environment in which the antenna system 100 operates. For instance, if a user removes the housing 102 from the stand 104 and hangs the housing on a wall using the slots 120 on the back cover 112, the signal line 106 may be positioned to extend away from the housing at any point along the bottom edge portion using the groove 136 and teeth 142 and 144. Or, if a user hangs the housing 102 on a wall or positions the housing in the stand, the signal line 106 may extend from either end of the groove 136 in a direction substantially parallel to the groove, thereby seeming to exit the housing from either of the opposing housing edges 115. Or, if a user places in the housing 102 in the stand 104 and rests the stand on a surface near a television, the signal line 106 may be positioned to extend away from the housing 102 in a direction approximately perpendicular to the sides of the flat panel housing 102 using either of the cable channels 214 and 216. And, once the signal line 106 is secured in one of the cable channels 214 or 216, it will remain in the approximately same position relative to the housing 102 even if the stand is moved around on the surface on which it rests.

In an exemplary embodiment, a user may configure the antenna system 100 in the following manner. Initially, the user must decide which of the many user configurations of the antenna system 100 to implement. For example, the user may configure the antenna system in the manner shown in FIG. 9. First, with the removable stand 104 detached from the housing 104, the user may locate the point at which the signal line 106 exits the housing 102 in the groove 136. Then, the user may insert the signal line 106 into the groove 136 such that it is secured by the teeth 142 and 144 and runs along the bottom edge portion 114 to the notch 122. Next, the user may bend the signal line approximately ninety degrees such that it passes through the notch 122 and extends from the back cover 112 in an approximately perpendicular manner. With the stand 104 resting on a surface, the user may then place the housing 102 into the brackets 202 and 204 and optimally position the housing within the stand. Specifically, optimally positioning the housing 102 within the stand 104 includes mating the convex positioners 212 on the stand 104 with the concave positioners 121 on the back cover 112 and threading the signal line 106 down through the cable slot 206 in the bracket 206. Once the housing 102 is positioned within the stand, the signal cable 106 may be inserted into the cable channel 214 and secured therein by the tooth 218. Finally, the user may connect the coax coupler 108 to a coax transmission line coupled to a television receiver.

Although illustrative embodiments have been shown and described, a wide range of modification, change, and substitution is contemplated in the foregoing disclosure and in some instances, some features of the present disclosure may be employed without a corresponding use of the other features. For example, in some embodiments, the components of an antenna system according to the present disclosure may have different dimensions and/or shapes and may be configured differently than the antenna systems shown in the Figures. For example, the antenna housing may be a circle, square, or other shape with lateral edges. It is understood that such variations may be made in the foregoing without departing from the scope of the present disclosure. Accordingly, it is appropriate that the appended claims be construed broadly and in a manner consistent with the scope of the present disclosure.

What is claimed is:

1. An antenna system for receiving a transmitted signal with signal receiving components, comprising:

a signal line electrically coupled to signal-receiving components; and a housing disposed about the signal-receiving components and securably connected with the signal line, the housing comprising:

a first housing portion forming a first side of the housing, the first housing portion including:
first and second opposing edge portions;
a third edge portion extending between the first and second opposing edge portions; and
a plurality of spaced first teeth protruding from the third edge portion;
a second housing portion forming a second side of the housing, the second housing portion including:
fourth and fifth opposing edge portions; and
a sixth edge portion extending between the fourth and fifth opposing edge portions, the sixth edge portion including a first notch adjacent to the fourth edge portion and a second notch adjacent to the fifth edge portion;
a plurality of spaced second teeth protruding from the sixth edge portion, wherein the second teeth protrude toward the first teeth;
wherein the first housing portion is configured to be coupled to the second housing portion in such a manner that the first and fourth edge portions engage to form a first housing edge portion, the second and fifth edge portions engage to form a second housing edge portion, and the first and second housing portion form a cavity therebetween, the signal-receiving components being disposed within the cavity,
and the third and sixth edge portions cooperatively form a groove that is elongated and extending between the first and the second housing edge portions, wherein the groove includes the first notch and the second notch, the groove being configured to receive the signal line, the plurality of spaced first teeth and second teeth extending into the groove and being configured to releasably secure the signal line in the groove, and the first and second notches and the plurality of spaced first and second teeth being in communication with the groove with 180 degrees of freedom such that the signal line exits the groove in one of: a perpendicular fashion, parallel to and along an axis of the groove, or to allow the signal line to exit the groove through one of the first and second notches.

2. The antenna system of claim 1,
wherein the first housing portion includes a first wall portion adjacent to the third edge portion, the first wall portion including a first aperture portion;
wherein the second housing portion includes a second wall portion adjacent to the sixth edge portion, the second wall portion including a second aperture portion; and
wherein the first housing portion is further configured to be coupled to the second housing portion in such a manner that the first wall portion engages the second wall portion and the first aperture portion and the second aperture portion form an aperture in communication with the groove, the signal line extending through the aperture and into the groove.

3. The antenna system of claim 1, wherein the housing includes a strain reliever inside the cavity, the strain reliever being structurally configured to reduce movement of the signal line within the cavity.

4. The antenna system of claim 1, wherein the housing includes hanging slots configured to engage with hanging implements.

5. The antenna system of claim 1,
including a removable stand having first and second elongated channels structurally configured to releasably secure the signal line therein;
wherein the removable stand is configured to receive the housing in such a manner that the first notch aligns with the first elongated channel and the second notch aligns with the second elongated channel to allow the signal line to extend through the groove and either pass through the first notch and extend through the first elongated channel or pass through the second notch and extend through the second elongated channel.

6. The antenna system of claim 1,
wherein the housing includes a first set of positioners adjacent to the sixth edge portion;
wherein the removable stand includes a second set of positioners configured to engage the first set of positioners; and
wherein the removable stand is further configured to receive the housing in such a manner that the first set of positioners engages the second set of positioners to align the first notch with the first elongated channel, to align the second notch with the second elongated channel, and to reduce movement of the housing relative to the stand.

7. An antenna system, comprising:
a housing having signal-receiving components therein, the housing including:
a front surface portion;
a back surface portion spaced from the front surface portion to form a cavity therebetween, the signal-receiving components being disposed within the cavity;
a plurality of first teeth located on the front surface portion, the first teeth being spaced apart and protrude toward the back surface portion;
a plurality of second teeth located on the back surface portion, the second teeth being spaced apart and protrude toward the front surface portion;
an edge portion extending between the front surface portion and the back surface portion, the edge portion having a first end and an opposing second end and including a groove that is elongated and extending between the first and second ends;
wherein the back surface portion includes a first notch and a second notch each in communication with the groove, wherein the first notch and the second notch each have a respective width;
wherein the plurality of first teeth and the second teeth each protrude into the groove and are configured to releasably secure the signal line within the groove;
a signal line electrically coupled to the signal-receiving components disposed within the cavity, the signal line being configured to receive signals and extending through an aperture formed in the edge portion within the groove, wherein the signal line has a diameter, and wherein the respective widths of the first and second notches are slightly larger than the diameter of the signal line such that when the signal line is placed in the first notch or the second notch, the signal line is releasably secured by said first notch or second notch; and
a stand structurally configured to receive the housing, the stand including:
a first bracket structurally configured to releasably receive the housing; and an first elongated channel extending away from the first bracket and being structurally configured to receive the signal line therein;

wherein the stand is operable to receive the housing in such a manner that the first notch on the back surface portion aligns the first elongated channel to allow the signal line to extend through the groove, pass through the first notch and extend through the first elongated channel, and that the second notch on the back surface portion aligns with the second elongated channel to allow the signal line to extend through the groove, pass through the second notch and extend through the second elongated channel.

8. The antenna system of claim 7, wherein the first notch is adjacent to the first end of the edge portion and wherein the second notch is adjacent to the second end of the edge portion;

wherein the stand includes a second bracket configured to releasably receive the housing; and wherein the stand includes a second elongated channel extending away from the second bracket and being structurally configured to receive the signal line therein.

9. The antenna system of claim 7, wherein the housing includes a first set of positioners;

wherein the stand includes a second set of positioners configured to engage the first set of positioners; and wherein the stand is further operable to receive the housing in such a manner that the first set of positioners engages the second set of positioners to align the first notch with the first elongated channel and to reduce movement of the housing relative to the stand.

10. The antenna system of claim 7, wherein the housing includes a strain reliever inside the cavity, the strain reliever being structurally configured to prevent movement of the signal line within the cavity.

11. The antenna system of claim 7, wherein the first elongated channel includes a retainer configured to further releasably secure the signal line within the first elongated channel.

12. The antenna system of claim 7, wherein the stand is further configured to position the housing in a manner perpendicular to a surface on which the stand rests.

13. The antenna system of claim 7, wherein housing includes hanging slots configured to engage with hanging implements.

14. The antenna system of claim 7, wherein the first elongated channel is configured to position the signal line in a manner such that it extends away from the back surface portion of the housing in an approximately perpendicular manner.

15. The antenna system of claim 7, wherein the stand is operable to receive the housing in such a manner to allow the signal line to extend through the groove and extend away from the housing in a manner approximately parallel to the front and back surface portions without passing through the first elongated channel on the stand.

16. The antenna system of claim 7, wherein the housing includes a plurality of teeth protruding from at least one of the front and back surface portions into the groove, wherein the plurality of teeth are configured to releasably secure the signal line within the groove.

17. A method of using an antenna system, comprising:

locating a signal line extending from an edge portion of an antenna housing, the signal line electrically coupled to signal-receiving components disposed within the antenna housing;

inserting the signal line into a groove that is elongated along the edge portion of the antenna housing, the edge portion including a plurality of first teeth and second teeth protruding into the groove and toward one another to releasably secure the signal line within the groove;

passing the signal line through one of a first notch and a second notch in the antenna housing, the first notch and the second notch extending approximately perpendicularly from the groove, and wherein the first notch and the second notch have respective widths that are slightly larger than a diameter of the signal line such that the signal line is releasably secured by the first notch or the second notch as it is passing through the first notch or the second notch;

releasably securing the antenna housing to a stand; and inserting the signal line into an elongated channel on the stand so that the signal line extends away from the antenna housing, the elongated channel being configured to releasably secure the signal line.

18. The method of claim 17, wherein the releasably securing the antenna housing to the stand includes inserting the antenna housing into a pair of brackets structurally configured to releasably receive the housing.

19. The method of claim 17, wherein the releasably securing the antenna housing to the stand includes positioning the antenna housing within the stand to align the first notch or the second notch with the elongated channel.

20. The method of claim 19, wherein the positioning the antenna housing includes engaging a first pair of positioners on the antenna housing with a second pair of positioners on the stand.

21. The method of claim 17, wherein the inserting the signal line into the elongated channel includes releasably securing the signal line with a retainer associated with the elongated channel.

* * * * *